US005574250A

United States Patent [19]

Hardie et al.

[11] Patent Number: 5,574,250

[45] Date of Patent: Nov. 12, 1996

[54] MULTIPLE DIFFERENTIAL PAIR CABLE

[75] Inventors: William G. Hardie; Craig R. Theorin, both of Landenberg, Pa.; Edward L. Kozlowski, Jr., Elkton, Md.; Herbert G. Van Deusen, Bear, Del.

[73] Assignee: W. L. Gore & Associates, Inc., Newark, Del.

[21] Appl. No.: 383,167

[22] Filed: Feb. 3, 1995

[51] Int. Cl.[6] ..... H01B 7/34

[52] U.S. Cl. ..... 174/36; 174/102 R; 174/109; 174/116

[58] Field of Search ..... 174/36, 34, 102 R, 174/109, 110 F, 110 FC, 113 C, 116

[56] References Cited

U.S. PATENT DOCUMENTS

| | | | |
|---|---|---|---|
| 483,285 | 9/1892 | Guilleaume . | |
| 1,818,027 | 8/1931 | Affel et al. . | |
| 1,854,255 | 4/1932 | Green . | |
| 2,029,420 | 2/1936 | Green | 178/44 |
| 2,029,421 | 2/1936 | Green et al. | 178/44 |
| 2,034,026 | 3/1936 | Curtis et al. | 178/44 |
| 2,034,033 | 3/1936 | Green et al. | 178/44 |
| 2,034,034 | 3/1936 | Green et al. | 178/44 |
| 2,034,047 | 3/1936 | Leibe et al. | 178/44 |
| 2,090,510 | 8/1937 | Bower | 173/264 X |
| 3,105,871 | 10/1963 | Eager, Jr. | 174/105 R |
| 3,358,248 | 12/1967 | Saad | 333/10 |
| 3,425,004 | 1/1969 | Warner | 333/79 |
| 3,673,315 | 6/1972 | Lasley | 174/107 |
| 3,975,473 | 8/1976 | Mulvaney | 264/23 |
| 4,549,042 | 10/1985 | Akiba et al. | 174/114 R X |
| 4,641,111 | 2/1987 | Chapell | 333/115 |
| 4,642,417 | 2/1987 | Ruthrof et al. | 174/36 |
| 4,654,476 | 3/1987 | Barnicol-Ottler et al. | 174/116 |
| 4,764,538 | 8/1988 | Buckmaster et al. | 521/85 |
| 4,777,324 | 10/1988 | Lee | 174/34 |
| 4,822,950 | 4/1989 | Schmitt | 174/36 |
| 4,868,565 | 9/1989 | Mettes et al. | 174/36 |
| 4,967,040 | 10/1990 | Vaiud et al. | 174/36 |
| 5,023,279 | 6/1991 | Buckmaster et al. | 521/85 |
| 5,032,621 | 7/1991 | Buckmaster et al. | 521/85 |
| 5,180,884 | 1/1993 | Aldissi | 174/36 |
| 5,210,377 | 5/1993 | Kennedy et al. | 174/107 X |
| 5,280,137 | 1/1994 | Ward | 174/120 SR X |
| 5,283,390 | 2/1994 | Hubis et al. | 174/36 |
| 5,321,202 | 6/1994 | Hillburn | 174/36 |
| 5,331,206 | 7/1994 | Liron | 307/270 |
| 5,349,133 | 9/1994 | Rogers | 174/36 |
| 5,393,929 | 2/1995 | Yagihashi | 174/36 |

FOREIGN PATENT DOCUMENTS

| | | | |
|---|---|---|---|
| 3012321 | 1/1981 | Germany . | |
| 999545 | 7/1965 | United Kingdom | 174/36 |

OTHER PUBLICATIONS

Paper–The Bell System Technical Journal, "The Proportioning of Shielded Circuits for Minimum High–Frequency Attenuation", vol. XV, No. 2, Apr. 1936, pp. 248–283.

Literature: High–Performance Parallel Interface; May 1, 1990, pp. 28–30, Computer & Business Equipment Manufacturers Assn.

Drawing: 25 AWG 150 Ohm Low Skew Paralle Pair Type CL2/FT4: Madison Cable Corporation; Date: Jan. 26, 1994.

*Primary Examiner*—Kristine L. Kincaid
*Assistant Examiner*—Chau N. Nguyen
*Attorney, Agent, or Firm*—Victor M. Genco, Jr.

[57] ABSTRACT

A quad or dual differential pair cable for bi-directional high speed differential signal transmission has a first differential pair of conductors and a second differential pair of conductors. The conductors extend in substantially parallel relation to one another and are electrically insulated from each other by an insulating dielectric. The dielectric and the conductors are surrounded by a conductive metal shield. The dielectric insulates the conductors both from each other and from the shield and is sufficiently crush resistant to maintain the conductors in substantially parallel relation to one another over the length of the cable, The shield may be covered with an optional jacket. Each wire of a differential pair of wires are oriented 180 degrees apart from one another. The distance between any one of the conductors and the shield is equal to or greater than the distance between that conductor and a center axis of the cable.

20 Claims, 4 Drawing Sheets

MULTIPLE DIFFERENTIAL PAIR CABLE

FIELD OF THE INVENTION

The present invention relates to cables, and more particularly, to a cable having two or more differential signal pairs.

BACKGROUND OF THE INVENTION

Electrical cables for data transmission are well known. One common cable is a coaxial cable. Coaxial cables generally comprise an electrically conductive wire surrounded by an insulator. The wire and insulator are surrounded by a shield, and the wire, insulator and shield are surrounded by a jacket, Coaxial cables are widely used and best known for cable television signal transmission and ethernet standard communications in local area networks. Coaxial cables can transmit at much higher frequencies than a standard twisted pair wire and, therefore, have a much greater transmission capacity. Coaxial cables provide data transmission at raw data rates of up to 10 Mbit/sec (Mbps). In addition, coaxial cables have very little distortion, cross-talk or signal loss, and therefore, provide a very reliable medium for data transmission. Other types of cables are also well known, such as twisted pair cables used for telephone signal transmission, and fiber optic cables.

With the proliferation of high-speed, powerful personal computers and the availability of advanced telecommunications equipment, there is a need for cables that are capable of transmitting data at ever faster speeds. Fiber optic cables provide optimum bandwidth and performance for long distance and high data rate transmissions, since fiber optic cables provide transmission with low attenuation and virtually no noise. Fiber optic cables provide data transmission at data rates up to and beyond 1 Gbit/sec (Gbps). However, despite the increased availability of fiber optic cables, the price of fiber optic cables and particularly transceivers have not dropped to a level where it is always practical to use, especially at short distances. Accordingly, other less expensive cables capable of high speed data transmission are still in demand.

One such cable used for high speed data transmission between two points or devices is a parallel pair or twin axial cable. Parallel pair cable designs provide two separately insulated conductors arranged side by side in parallel relation, the pair being then wrapped in a shield. This style cable is often used in computers, telecommunications and automatic test equipment where high data rate, high fidelity signal transmission is required.

Parallel pair cables are often used for differential signal transmission. In differential signal transmission, two conductors are used for each data signal transmitted and the information conveyed is represented as the difference in voltage between the two conductors. The data is represented by polarity reversals on the wire pair, unlike a coaxial cable where data is represented by the polarity of the center conductor with respect to ground. Thus, the amplitude of the ground potential on a shielded pair cable is not significant as long as it is not so high as to cause electrical breakdown in the receiver circuitry. The receiver only needs to determine whether the relative voltage between the two conductors is that appropriate to a logical 0 or 1. Accordingly, differential signal transmission provides a better signal-to-noise ratio than voltage level to ground signal transmission (also called single-ended transmission) because the signal voltage level is effectively doubled by transmitting the signal simultaneously over both conductors, with one conductor transmitting the signal 180 degrees out of phase from the other. Differential signal transmission provides a balanced signal that is relatively immune to noise and cross-talk. Interfering signals (or "noise") are generally voltages relative to ground and will affect both conductors equally. Since the receiver takes the difference between the two received voltages, the noise components added to the transmitted signal (on each wire) are negated. This noise is called common-mode noise, and the differential property of the receiver which negates the effect of this noise is known as common mode noise rejection. A Standard for differential transmission systems is EIA standard RS-422.

In order to transmit the differential signal along a twin axial cable effectively, the signals on each conductor must propagate down the wire with very low skew. The amount of differential skew per unit length that is allowable is inversely proportional to both the distance of the cable and the data rate at which the signal is transmitted. For example, when transmitting at a data rate of 1000 Mbps, the bit width is approximately 1000 pSec wide. If the difference between the two signals on the differential cable is greater than 200 pSec, errors in communication may occur. If the differential signal is being transmitted 30 meters, then the safe maximum skew would be less than 7 pSec/meter.

Unfortunately, for most existing twin axial cables, typical differential skew is about 16–32 pSec/meter. This type of skew level limits the use-length of 1000 Mbps data transmission to less than 6 meters. As is discussed above, this significantly exceeds the safe level of skew for greater cable lengths. Accordingly, existing twin axial cables are restricted in their ability to effectively transmit differential signals at a high data rate over an extended length.

Low differential skew is also required for proper cancellation of noise. If signals arrive at the receiver at different times, any coupled noise will not be able to cancel, defeating the primary purpose of a twin axial cable. Furthermore, the emitted noise will increase due to reduced cancellation of the high frequency currents on the cable's shield. The present constraints on managing differential skew in conventional twin axial cables severely limits the use of differential signal transmission in more demanding applications. Accordingly, many designers have been forced to switch to far more expensive fiber optic technology for long distance, high data rate transmission.

Therefore, it would be desirable to provide a cable capable of high data rate differential signal transmission at higher speeds and longer distances than achieved by existing differential pair cables. This requires having lower differential skew between paired conductors and lower attenuation than is achieved by existing differential pair cables and providing lower interference from cross-talk and intermodulation noise.

An additional cable construction used for transmitting differential signals is the quad cable. Quad cable designs provide four separately insulated conductors arranged around a central axis at equal circumferential intervals, the insulated conductors then being wrapped in a shield. For moderate data transmission speeds (i.e., less than 200 Mbit/sec), quad cables have been used by transmitting two differential pairs, each pair comprising two conductors, with each conductor oriented generally 180° apart from the other in the pair. The advantage to this type of transmission line is that by having two differential pairs within a single shield, the overall cable size is reduced by approximately 40% when compared with using two separate twin axial cables. This allows for reduced cost and ease of routing cables.

Quad cables today have not been used beyond 200 Mbit/sec data rates because of signal degradation resulting from cross-talk and pulse attenuation. While twin-axial cables typically have equal or lower signal attenuation, when compared with a coax cable of equivalent conductor size, dielectric and shield materials, and impedance, quad cables typically have higher attenuation than a similarly constructed coax. This problem is exaggerated when using relatively inexpensive polyester backed foil shields due to the relatively high resistance in these types of materials. Attenuation will limit both the maximum data rate of transmission as well as the maximum distance of transmission.

Furthermore, differential skew within the quad cable will result in cross-talk between the two differential pairs in the cable. This requires precise control of the balance of material properties and construction within the quad cable in order to achieve adequate performance at longer lengths or higher data rates. Today, the maximum performance specified for a quad cable is 20 meters at 200 Mbit/sec. It would be desirable to provide a cable capable of higher data rate transmission, having the same or smaller size than the quad cable, that is capable of longer distance transmission without significantly increasing the cable cost.

SUMMARY OF THE INVENTION

Briefly stated, the present invention is directed to a multiple pair differential signal transmission cable that has very low signal attenuation and signal skew properties. The attenuation and low skew properties of the present invention are achieved by a unique combination of conductors disposed in parallel with (or 180° apart from) each other in a predetermined geometric configuration combined with insulation and shielding materials, and wherein the distance of each conductor from the shield is approximately equal to or greater than the distance of each conductor from a center axis of the cable.

In its basic form, the cable of the present invention comprises an even numbered plurality of electrical conductors forming a plurality of differential pairs of electrical conductors, the conductors being spaced apart in generally equidistant circumferential intervals and extending over the length of the cable, each differential pair comprising two conductors generally 180° apart from each other and an additional insulation layer is shared by the insulated conductors. Insulation is disposed between the conductors for electrically insulating the conductors from each other. An electrically conductive shield surrounds the conductors and the insulation and the insulation further electrically insulates the shield from the conductors. A means for maintaining the conductors in the spaced apart intervals over the length of the cable is also provided. In addition, the cable is constructed of materials and configured to maintain each conductor at an approximately equal to or greater distance from the shield than from a center axis of the cable over the length of the cable.

The plurality of differential pairs transmit a corresponding plurality of high frequency differential signals by way of each differential pair and the plurality of transmitted high frequency signals experience low skew within each differential pair resulting in low signal interference from cross-talk and intermodulation noise between the different differential pairs. Furthermore, this cable exhibits significantly lower attenuation when compared to existing cables.

The insulation is generally crush resistant and preferably constructed of foamed fluorinated ethylene propylene copolymer (FEP) insulation so that the geometric configuration of the conductors and the distance between each conductor and the shield and each conductor and the center axis of the cable is maintained over the length of the cable. The combination of these elements and the geometry of the elements transmits differential signals that experience remarkably low skew between the paired conductors and lower attenuation than existing cables. This results in a cable capable of reliably transmitting high speed bi-directional signals over an extended length. The cable, in one form is capable of transmitting data rate in excess of 1 Gbit/sec at distances over 30 meters, which is vastly improved over existing differential pair cable constructions of similar size. Additionally, the presence of spacer layer over the separately insulated conductors, reduces the effect that crushing or within core variations has on skew. This unique construction allows for the use of less crush resistant materials, such as expanded polytetrafluoroethylene (ePTFE), by reducing the differential skew that results from a given amount of dielectric material variability.

Furthermore, the dependency of signal attenuation on shield material conductivity has been reduced, so less expensive, higher density shield materials, such as aluminized polyester, are now applicable at higher data rates and longer distance transmission than on existing cables.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangement and instrumentality shown. In the drawings.

DETAILED DESCRIPTION OF PREFERRED EMBODIMENTS

Figure 1:
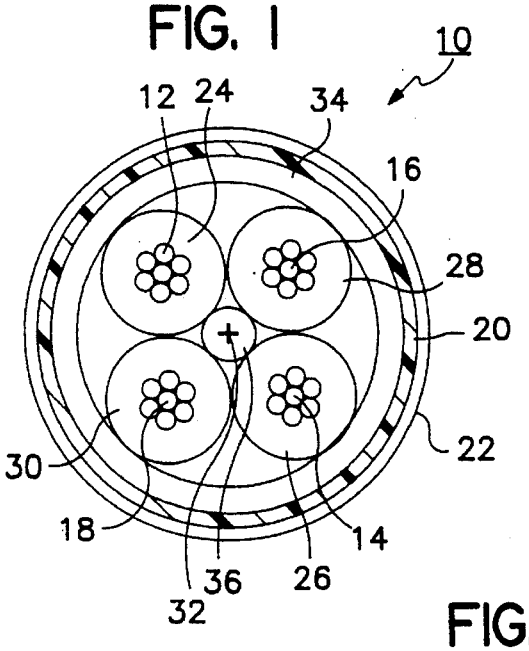
FIG. 1 is an enlarged cross-section view of a first embodiment of a multiple differential pair cable in accordance with the present invention.

The present invention is an improved quad cable for the high speed transmission of signals. A "quad cable" generally encompasses a cable that employs more than one pair of differential signal cables within a common shield. This construction usually comprises two pairs of differential signal cables, but may also include other constructions where multiple pairs of cables are arranged within a common shield. For consistency herein, these cables as a group will be referred to "multiple differential pair cables."

As has been explained, prior to the present invention, there were severe limitations on the transmission speeds that could be achieved with multiple differential pair cables. A number of problems emerged whereby interference generated within the cable limited its effective operating speed to about 200 Mbit/sec over about 20 meters. Where greater speeds and/or greater lengths were required, some other cable construction, such as two or more separately shielded twin axial cables, would have to be employed.

Quite unexpectedly, it has been determined in the present invention that the relative position of the conductors in a multiple differential pair cable between the shield and the central axis of the cable plays a critical role in the maximum effective speed (i.e., data rate) of the cable. Previously, quad cables have employed a construction with little regard to the placement of the conductor relative to the shield and the center of the cable. With a typical construction of a quad cable, the dielectric surrounding each conductor is generally symmetrical. The symmetrically insulated cables are arranged in a group and the shield is then wrapped around the group of cables. The effect of this construction is that distance between each of the conductors and the shield is less than the distance between each conductor and the central axis of the cable. Generally, this amounts to a ratio of (distance of conductor to shield) / (distance of conductor to central axis of the cable) of 0.7 or less.

It is now known that by constructing the cable whereby the distance between all of the conductors and the shield is essentially equal to or greater than the distance between the conductor and the central axis of the cable, a cable with significantly improved properties is provided. A cable made in accordance with the present invention is capable of transmitting high data rates on the order of 1000 Mbps with a low time delay skew characteristics of less than 6.66 pSec/m (on the order of less than 200 pSec/30 m). Previous parallel pair cables generally transmit data at speeds on the order of 250 Mbps and have a time delay skew on the order of 32.8 pSec/m.

In terms of the ratio of (distance of conductor to shield) / (distance of conductor to central axis of the cable), a cable of the present invention ideally has a ratio of 1.0 or greater. However, improvement in electrical performance can be demonstrated with cables having a ratio of 0.9 or greater, and even as low as 0.8 or greater.

Referring now to FIG. 1, one embodiment of a multiple differential pair cable 10 of the present invention is shown having an even numbered plurality of electrical conductors 12, 14, 16, 18. The electrical conductors form a plurality of differential pairs of electrical conductors, with conductors 12 and 14 forming a first differential pair and conductors 16 and 18 forming a second differential pair. In this instance, the conductors 12–18 comprise multiple strand wires, but this present invention functions equally well using single strand wires. The cable differs from a pair of twin ax cables in that all of the conductors are all surrounded by a single shield 20 and are located within a single jacket 22.

As can be seen, the conductors 12, 14, 16, 18 are spaced apart in generally equidistant circumferential intervals and extend substantially parallel or helical with respect to each other over the length of the cable. The overall geometric shape of the cable is round. In the preferred embodiment shown, the conductors of each differential pair are generally spaced 180° apart from each other, which in a quad configuration, as shown, places the four conductors circumferentially spaced apart in approximately 90° intervals.

It is important that each of the conductors be electrically insulated from each other and from the surrounding shield 20. This insulation can be accomplished by an independent insulation material separating the conductors from each other and another independent insulation material separating the conductors from the shield, or through the use of a single insulation layer that accomplishes both of these functions. In the embodiment illustrated, each of the conductors 12, 14, 16, 18 is surrounded by its own insulation layer 24, 26, 28, 30, respectively.

It has been explained that an unexpected benefit has been achieved with the present invention by positioning the conductors closer to a central axis 32 of the cable than to the shield 20. In order to produce such an orientation with the cable illustrated in FIG. 1, a second insulation spacer layer 34 of dielectric material is positioned around the insulated conductors 12, 14, 16, 18 in order to position the conductors essentially equidistant between the shield 20 and the central axis 32. By constructing the cable in this manner, it has been determined that significantly lower attenuation and time delay skew can be achieved over a comparable quad cable not having such a spacer layer.

Finally, a center filler 36 is provided in the center of the conductors 12, 14, 16, 18 in this embodiment to assist in maintaining the relative position between the conductors and shield within the cable 10. Again, it is preferable that the filler 36 comprise a dielectric material that will not disrupt the electric properties within the cable. The filler 36 is preferably circular in cross-section and is smaller in diameter than the insulating dielectrics 24–30 so that adjacent dielectrics contact each other. The filler 36 can be constructed as a solid tube of material, a hollow tube, or a material with a cellular structure to reduce dielectric constant. Preferably, the filler 36 is constructed of a foamed fluoropolymer, as that used for the insulating dielectrics, or an expanded polytetrafluoroethylene (ePTFE).

Figure 2:
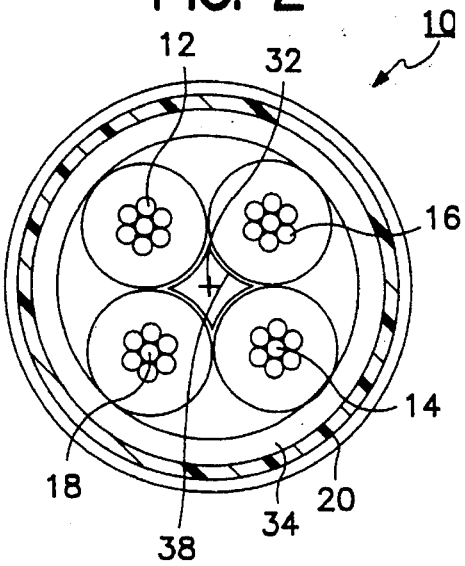
FIG. 2 is an enlarged cross-section view of a second embodiment of a multiple differential pair cable in accordance with the present invention.

The cable illustrated in FIG. 2 employs essentially the same construction as that shown in FIG. 1 except that no center filler material is used. This type of construction is suitable for those applications where lateral stress and strain on the cable will be minimal and there is little risk of the cables undergoing a change in relative position within the cable. Alternatively, as is shown, the conductors 12, 14, 16, 18 can be maintained in their relative positions by providing an adhesive layer 38 in the center of the cable, adhering the conductors into their correct positions within the cable. Suitable adhesives for this application may include a polyethylene skin coating. Alternatively, adjacent conductors can be fusion bonded to each other in order to maintain the conductors at circumferential spaced intervals.

Although the cables 10 shown in FIGS. 1 and 2 both employ two differential pairs, it should be understood that it may be possible to construct the cable of the present invention to include three or more pairs of conductors so long as the same general geometry of the present invention is maintained.

The conductors 12–18 may be constructed of any electrically conductive material, such as copper, copper alloys, metal plated copper, aluminum or steel. Although many different conductors may be used, the presently preferred embodiments are constructed of a plurality of twisted copper strands which are plated with silver or tin.

The insulation 24–30 is preferably formed from a generally crush resistant material to avoid significant changes in insulative properties of the dielectric upon the application of tensions and forces associated with handling the cable. In addition, it is preferred that the insulation is constructed of a material that has a low dielectric constant. Suitable dielectric insulations for use in the present invention include foamed polymers, such as foamed thermoplastic materials. Most preferably, the insulation used with the present invention comprises a foamed thermoplastic polymer selected from the group consisting essentially of fluorinated ethylene propylene copolymer (FEP), perfluoroalkoxy copolymer (PFA), ethylene tetrafluoroethylene copolymer (ETFE), polyethylene, polypropylene, polyolefin copolymers, and polyallomers. Alternatively, it may be possible to construct the dielectric from certain non-foamed materials, such as expanded polytetrafluoroethylene polymer (ePTFE), by making such materials sufficiently crush resistant or configuring the material to reduce the effects of crushing. Similarly, the spacer layer 34 may be constructed from any suitable dielectric material but is preferably constructed from a crush-resistant dielectric material such as those listed above. The use of a dielectric spacer material provides another layer of electrical insulation between the conductors and the shield. The dielectric insulation material surrounding the conductors 12–18 are preferably held in contact with each other to provide the conductors with matched physical and electrical length.

The outer jacket 22 that is preferably placed around and surrounds the shield 20, the insulating dielectrics 24–30 and the conductors 12–18, provides a number of useful properties. First, the jacket is useful for electrically insulating the shield 20, preventing contamination of the shield 20 and inhibiting the introduction of high dielectric contaminants, such as water, within the cable. The jacket 22 can also serve as a surface for marking or coding the cable 10. The jacket 24 may be constructed of polyvinylchloride (PVC), PVC compounds, FEP, or similar polymers and is generally between about 0.010 and 0.030 inches thick. The jacket 22 may be extruded over or otherwise positioned around the shield 20.

Figures 6, 7:
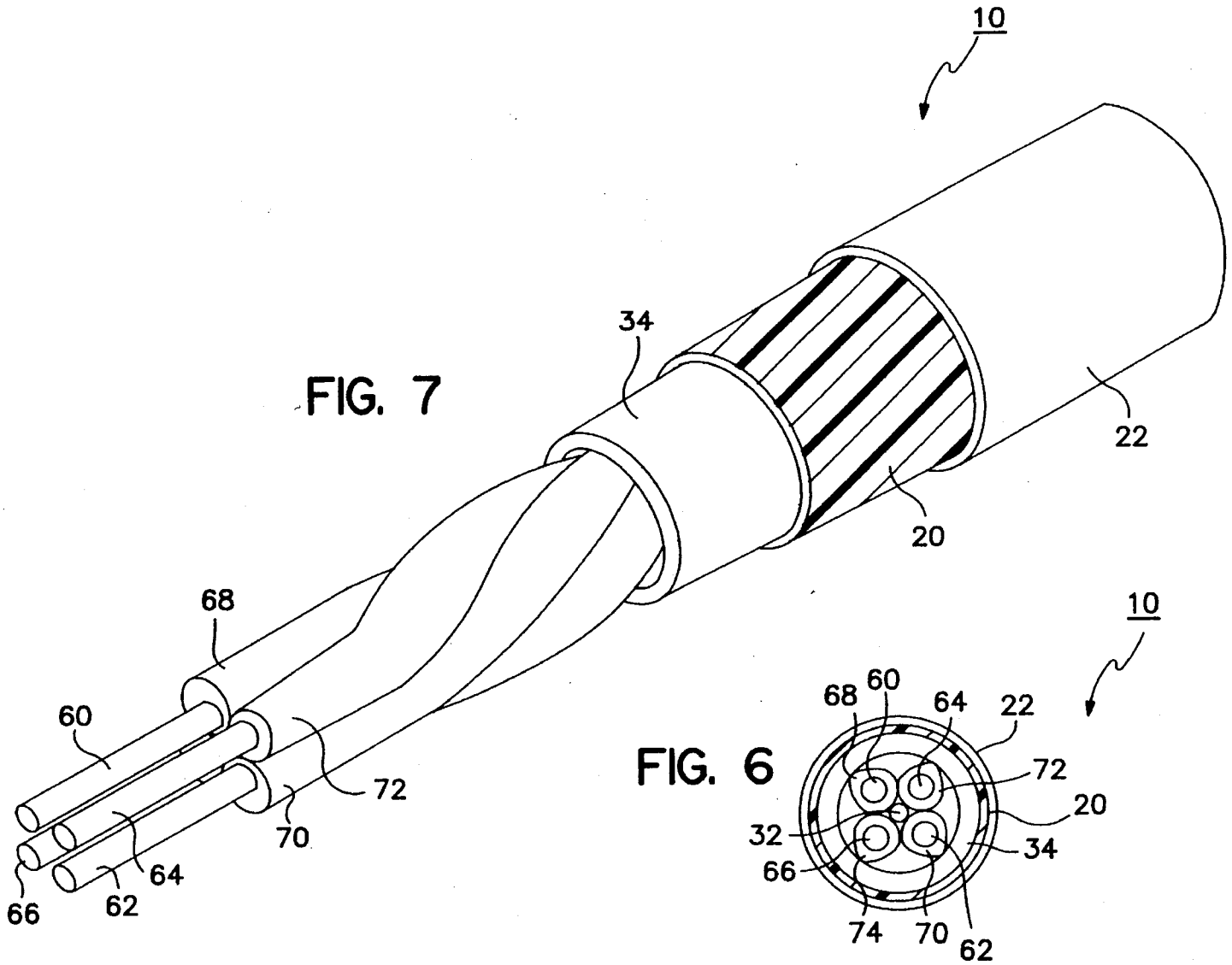
FIG. 6 is an enlarged cross-section view of a sixth embodiment of multiple differential pair cable in accordance with the present invention.
FIG. 7 is an enlarged perspective view of the multiple differential pair cable shown in FIG. 6.

In addition, it is also preferred that the conductors 12–18 and the respective insulating dielectrics 24–30 are in twisted relation to each other within the shield 20, as is illustrated in FIG. 7. Twisting the conductors 12–18 prevents pistoning of the conductors over the length of the cable 10 and also counteracts the effects of magnetic interference. Magnetic interference is reduced by twisting the conductors in that a magnetic field effect at one point is counteracted by the effect of the field on the other conductors one half twist away. The twisting of the conductors should be monitored and controlled to ensure that no length variation between conductors is introduced over the length of the cable.

The shield 20 employed with the present invention is preferably constructed of a plurality of interwoven, electrically conductive strands that surround the conductors 12–18 and the insulating dielectrics 24–30. The shield 20 prevents unwanted electromagnetic interference from causing significant signal losses and limits the amount of energy radiated from the cable 10. In addition, the arrangement of the shield 20 and the conductors 12–18 provides the cable 10 with the highest characteristic impedance for a given overall cable diameter resulting in lower losses at high frequencies. Although a braided metal shield is preferred, other known shielding methods, such as served wire shields and wrapped foils, such as aluminized polyester, may provide adequate performance in the multiple differential pair cables of the present invention due to the reduced interaction with the shield layer created by the spacer layer. It is important to note that the improved electrical properties of the cable of the present invention permit the use of far less expensive polyester foil shields in place of the braided metal shields presently employed in high speed cables. This can dramatically reduce the cost of materials and labor in constructing the high speed cable of the present invention.

It is believed that the spacer layer 34 employed with the present invention should be thick enough to provide a significant separation between the shield 20 and each of the conductors 12–18. As has been noted, in the cables 10 shown in FIGS. 1 and 2, the distance between each of the conductors and the shield is approximately equal to the distance between the conductors and the central axis 32 of the cable. It is believed that still better electrical performance properties may be achieved through the use of an even thicker spacer layer 34, whereby the distance between the conductors and the shield is even greater than the distance between the conductors and the central axis (i.e., having a ratio of >1.0). With regard to the benefits provided by the present invention, it would appear that the size of the spacer layer may be beneficially increased up to the space or cost constraints on the maximum cable diameter that can be tolerated for a given application.

Figure 3:
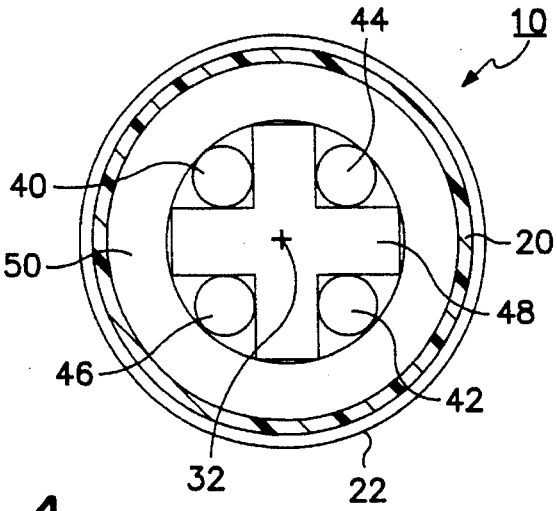
FIG. 3 is an enlarged cross-section view of a third embodiment of a multiple differential pair cable in accordance with the present invention.

Another embodiment of a cable 10 of the present invention is illustrated in FIG. 3. This cable 10 comprises four bare conductors 40, 42, 44, 46 that are insulated from each other by an insulating core 48, centrally located between the conductors to insulate the conductors from each other, and an enlarged insulating spacer layer 50 surrounding the conductors and insulating the conductors from the shield 20. In the embodiment shown, the insulating core 48 comprises a helical dielectric material having essentially an X-shaped cross-section. The advantage of this construction is that the conductors need not be individually insulated and it may be possible to provide high speed assembly of this cable. In this instance, the distance between each of the conductors 40–46 and the shield 20 is greater than the distance between the conductors and the central axis 32 of the cable 10.

The insulating core 48 is preferably constructed from a low dielectric material, such as an extruded PTFE, polyethylene, or ePTFE, and the enlarged spacer layer 50 is constructed from a low dielectric material, such as a foamed fluoropolymer, or ePTFE. In the preferred form of this embodiment, the insulating core is constructed from polyethylene. By providing a shared dielectric in the form of insulating core 48, the same variability between conductors is maintained over the length of the cable 10. In order to tightly control skew between conductors in a differential pair so that data signals can be transmitted at high rates (>250 Mbps), the cable 10 is constructed of materials and configured to maintain the conductors in substantially the same physical and electrical relation over the length of the cable.

Figure 4:
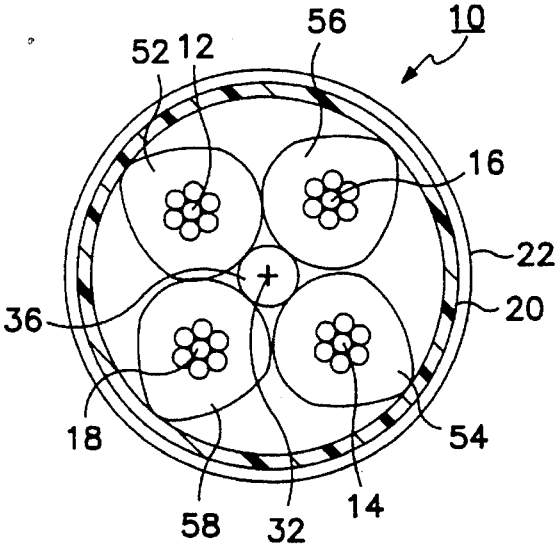
FIG. 4 is an enlarged cross-section view of a fourth embodiment of a multiple differential parallel pair cable in accordance with the present invention.
Figure 5:
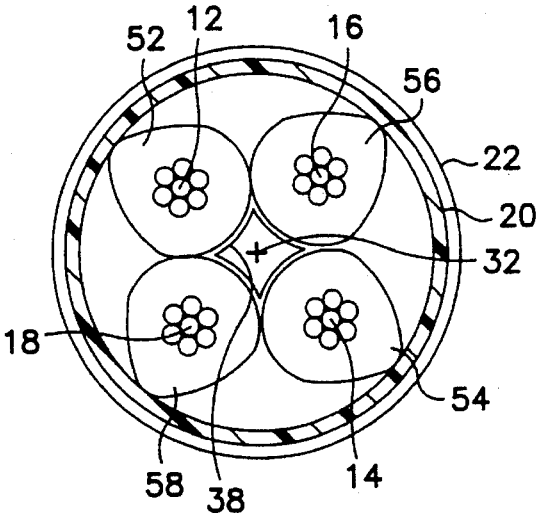
FIG. 5 is an enlarged cross-section view of a fifth embodiment of a multiple differential parallel pair cable in accordance with the present invention.

FIGS. 4 and 5 are cross sectional views of still two more embodiments of cables 10 of the present invention. In these embodiments, each of conductors 12, 14, 16, 18 is surrounded by an asymmetric insulating dielectric layer 52, 54, 56, 58. The insulating layers 52–58 each has an oblong cross-section, with the conductor positioned off-center in the insulation, as shown. By constructing the insulated conductors in this manner, and then assembling the conductors into a cable having the conductors positioned toward the center of the cable 10, the conductors are instantly positioned closer to the central axis 32 of the cable 10 than to the shield 20. Accordingly, the benefit of the present invention can be provided without the necessity of a separate spacer layer.

In the embodiment of FIG. 4, as was explained above with regard to the embodiment of FIG. 1, the cable 10 includes a filler 36 to assist in maintaining the relative positions of the conductors within the cable. In the embodiment of FIG. 5, as was explained above with regard to the embodiment of FIG. 2, the cable 10 includes an adhesive 38 or similar material to assist in maintaining such relative positions.

Still another embodiment of a cable of the present invention is shown in FIGS. 6 and 7. This cable comprises a hybrid of the embodiments of FIGS. 1 and 4 whereby the cable 10 includes four conductors 60, 62, 64, 66, each surrounded by asymmetric dielectric insulation 68, 70, 72, 74, a spacer layer 34, a shield 20, and a cable jacket 22. A center filler 34 is again provided. As can be seen in this construction, the conductors 60–66 are oriented very close to the central axis of the cable relative to the shield 20.

Figure 8:
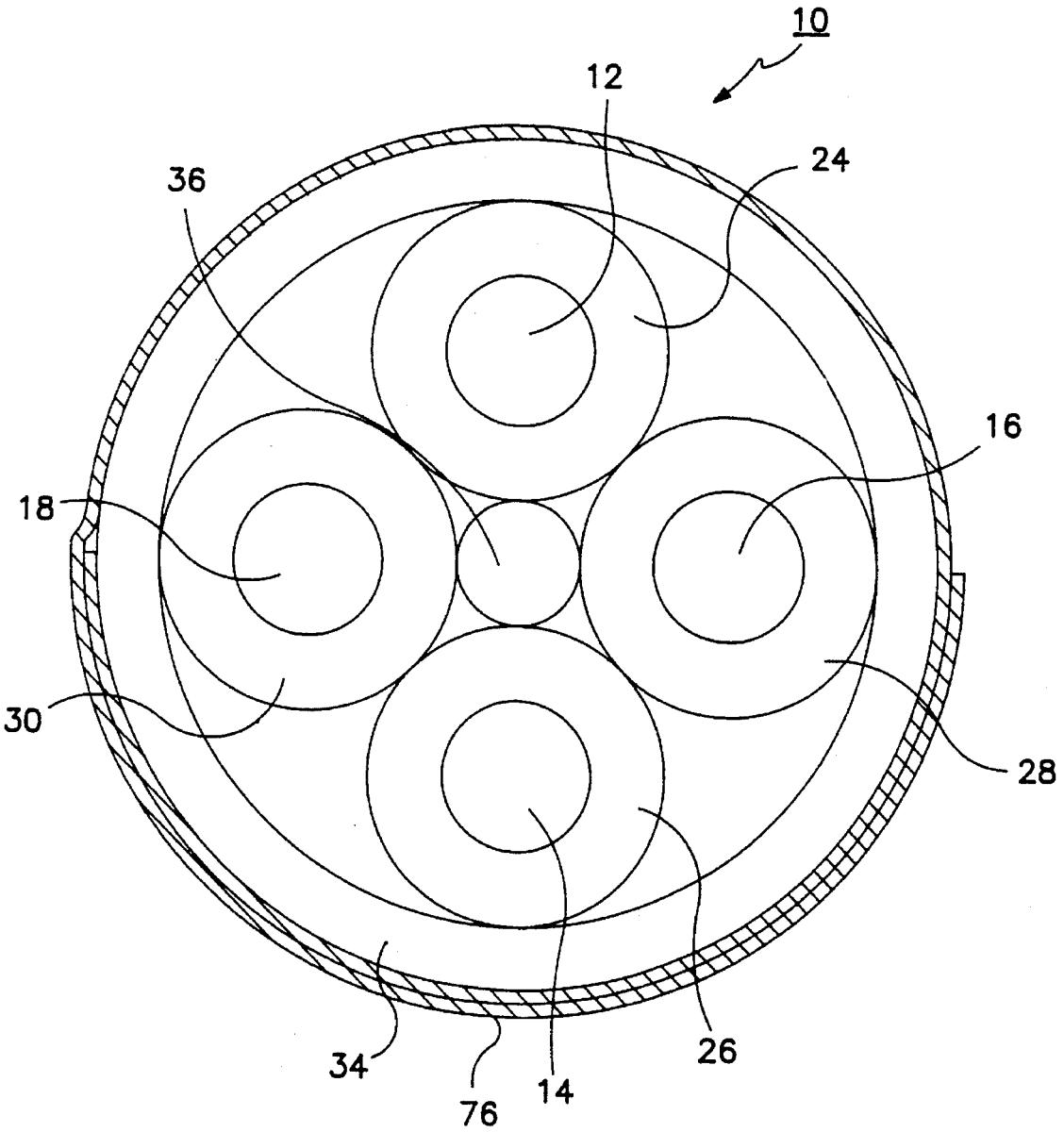
FIG. 8 is an enlarged cross-section view of seventh embodiment of a multiple differential pair cable in accordance with the present invention.

FIG. 8 illustrates a cable 10 of the present invention that utilizes a wrapped foil shield 76. As has been noted, a metalized polyester or similar material is less expensive to purchase and assemble than a braided metal shield. Generally, with high speed cables such shields are not appropriate due to insufficient protection from electric interference. However, the improved properties of the cable of the present invention allow these thinner, less expensive, materials to be used successfully without seriously sacrificing cable performance. It should be noted that this type of cable would normally have a cable jacket (not shown), unless it is to be incorporated into another structure, such as that shown in FIG. 9.

Figure 9:
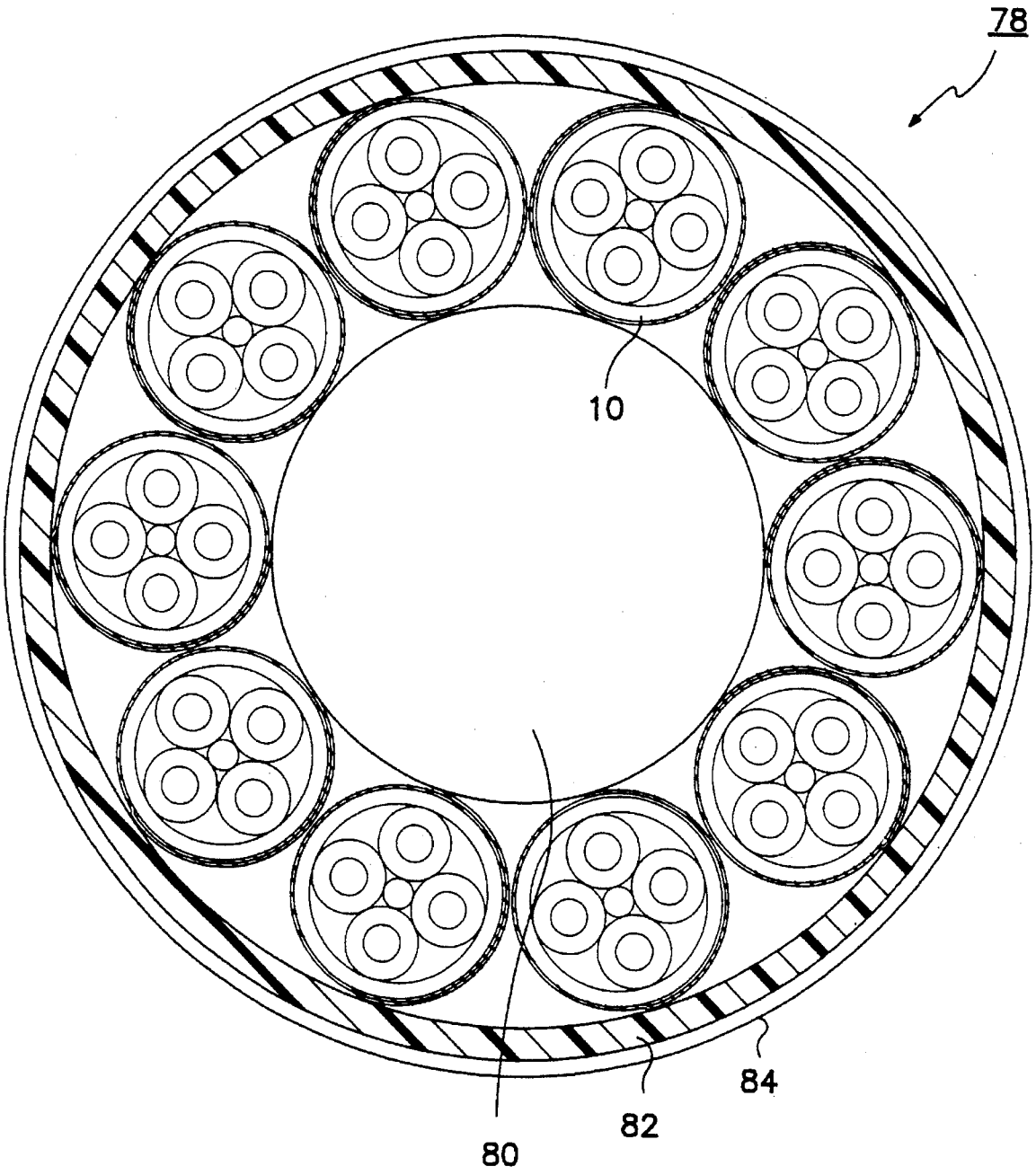
FIG. 9 is an enlarged cross-section view of a round cable constructed with a plurality of multiple differential pair cables of the present invention.

Although the cable of the present invention can be employed quite successfully alone, FIG. 9 demonstrates that multiple cables can be combined into a large round cable 78. As can be seen, this cable 78 comprises ten quad cables 10 of the construction illustrated in FIG. 8 arranged around a common center 80 and commonly shielded by braided shield 82 and jacket 84. It should be evident that constructed in this manner, a round cable 78 incorporating the multiple differential cables 10 of the present invention is capable of transmitting very high numbers of data signals.

In all embodiments of the present invention, the plurality of differential pairs within the cable transmits a corresponding plurality of high frequency signals by way of each differential pair, with the plurality of transmitted high frequency signals experiencing low skew within each differential pair and low interference from cross-talk and intermodulation noise between the different differential pairs.

Although parallel pair cables and dual parallel pair cables for differential signal transmission are known and have been used for many years, multiple parallel pair cables have not been constructed having all of the conductors surrounded by a single shield and a single jacket for long-distance high speed transmission of differential signals (on the order of 1 Gbps). Moreover, differential pair cables have not been constructed where the distance between all of the conductors and the shield is greater than or equal to the distance between that conductor and the central axis of the cable over the length of the cable. It has been found that the unique cable geometry used in the present invention, along with pairing diagonal conductors for differential signal transmission, provides surprisingly good results, such that the cable 10 of the present invention has very low time delay skew characteristics (less than 200 pSec/30 m). Previous parallel pair cables generally transmit data at speeds on the order of 250 Mbps and have a time delay skew on the order of 32.8 pSec/m, whereas the cables 10 of the present invention are capable of transmitting at speeds on the order of 1000 Mbps with a time delay skew of less than 6.66 pSec/m. In addition, the physical size of the cable of the present invention is much smaller than the size of prior cables, so that the cable is less expensive to manufacture, easier to route between two points, and uses less space.

From the foregoing description, it can be seen that the preferred embodiment of the invention comprises a dual differential pair cable for bi-directional signal transmission at high data rates. The cable exhibits excellent bandwidth and very low skew characteristics, so that signals transmitted by way of the differential pairs are not overly skewed between pairs even when transmitted over long distances or when the cable is subjected to bending or twisting. Further, the cable can be easily and efficiently manufactured.

It will be appreciated that changes and modifications may be made to the above described embodiments without departing from the inventive concept thereof.

Certain terminology is used in the following description for convenience only and is not limiting. The terminology employed includes the words specifically mentioned, derivatives thereof and words of similar import.

Therefore, it is understood that the present invention is not limited to the particular embodiment disclosed, but is intended to include all modifications and changes which are within the scope and spirit of the invention as defined by the appended claims.

We claim:

1. A high speed data transmission cable having a plurality of differential conductor pairs, a length and a central axis comprising:

each differential pair comprising two conductors generally 180° apart from each other;

a first insulation electrically insulating the conductors from each other;

an electrically conductive shield surrounding the conductors and the insulation; and a second insulation surrounding all the differential pairs and distancing the differential pairs from the shield;

wherein the second insulation layer serves to separate the distance between any one of the conductors and the shield to be greater than the distance between that conductor and the central axis of the cable so as to lower attenuation of the cable.

2. The cable of claim 1 wherein the first insulation comprises a layer of insulating dielectric around each of the conductors.

3. The cable of claim 2 wherein each of the insulating dielectrics extends in a constant relative position with respect to the other dielectrics providing the conductors with matched physical and electrical length.

4. The cable of claim 3 wherein the conductors are helically oriented around the central axis.

5. The cable of claim 1 further comprising a filler centrally disposed between the conductors.

6. The cable of claim 1 wherein the first insulation comprises an insulating core centrally located between the conductors insulating the conductors from each other; and the second insulation comprises an insulating dielectric layer surrounding the conductors and the insulating core for insulating the conductors from the shield.

7. The cable of claim 1 wherein the plurality of electrical conductors comprises four electrical conductors forming first and second differential pairs of electrical conductors, the conductors being circumferentially spaced apart in approximately 90° intervals.

8. A quad pair data transmission cable having a length and a central axis comprising:

four electrical conductors defining first and second diagonal pairs of differential pair conductors, the conductors being spaced apart in generally constant relative position to each other over the length of the cable;

insulating dielectric surrounding each of the four conductors, insulating the conductors from each other;

an electrically conductive shield surrounding the conductors and the insulating dielectrics; and a layer of insulation surrounding all the differential pairs and distancing the differential pairs from the shield;

wherein the layer of insulation surrounding the differential pairs serves to increase the distance between any one of the conductors and the shield to be greater than the distance between that conductor and the central axis of the cable so as to lower attenuation of the cable.

9. The cable of claim 8 further comprising a filler centrally disposed between the conductors.

10. The cable of claim 8 further comprising a layer of insulating dielectric surrounding the insulated conductors within and concentric with the shield.

11. The cable of claim 8 wherein the shield is an electrically conductive braid.

12. The cable of claim 8 wherein the shield is an electrically conductive foil.

13. A high speed data transmission cable having a plurality of differential conductor pairs, a length and a center axis comprising:

each differential pair comprising two conductors generally 180° apart from each other;

an electrically conductive shield surrounding all the differential pairs;

an asymmetrical layer of insulating dielectric surrounding each of the conductors in order to maintain each of the conductors at a distance from the shield which is substantially equal to or greater than the distance between that conductor and the center axis of the cable.

14. The cable of claim 13 wherein a ratio of the distances between conductor and the shield relative to the distance between the conductor and the central axis is greater than 1.0.

15. The cable of claim 13 wherein the shield comprises an electrically conductive foil.

16. The cable of claim 13 further comprising a filler centrally disposed between the conductors.

17. The cable of claim 13 wherein each of the insulating dielectrics extends in a constant relative position with respect to the other dielectrics providing the conductors with matched physical and electrical length.

18. The cable of claim 17 wherein the conductors are helically oriented around the center axis.

19. The cable of claim 13 wherein the shield is an electrically conductive braid.

20. The cable of claim 13 wherein the shield is an electrically conductive foil.

* * * * *